United States Patent [19]

Walter et al.

[11] 4,221,050

[45] Sep. 9, 1980

[54] CUTTING TOOL

[75] Inventors: Henry J. Walter, Wilton, Conn.; William Mack, Commack, N.Y.

[73] Assignee: Clairol Inc., New York, N.Y.

[21] Appl. No.: 823,796

[22] Filed: Aug. 11, 1977

[51] Int. Cl.[2] ..... B26B 19/02

[52] U.S. Cl. ..... 30/216

[58] Field of Search ..... 30/215-220, 30/208, 210, 369, 200, 201, 392, 394, 272, 372, 272 A, 356

[56] References Cited

U.S. PATENT DOCUMENTS

| | | | |
|---|---|---|---|
| 1,123,980 | 1/1915 | Beardsley | 30/220 |
| 1,175,023 | 3/1916 | Szabo | 30/30 |
| 1,269,880 | 6/1918 | Trowbridge | 30/220 |
| 1,428,836 | 9/1922 | Campbell | 30/210 |
| 2,293,637 | 8/1942 | Bourque | 30/216 |
| 2,717,443 | 9/1955 | Turbett | 30/210 |
| 3,513,544 | 5/1970 | Ranger | 30/272 |
| 3,646,675 | 3/1972 | Wezel | 30/217 |

FOREIGN PATENT DOCUMENTS

| | | | |
|---|---|---|---|
| 649465 | 8/1937 | Fed. Rep. of Germany | 30/216 |

*Primary Examiner*—Othell M. Simpson
*Assistant Examiner*—Roscoe V. Parker
*Attorney, Agent, or Firm*—Sherman & Shalloway

[57] ABSTRACT

A shear is disclosed in a preferred form which is particularly suited for cutting and trimming hair and which includes means for varying the length of stroke of the cutting blade or blades which reciprocate generally parallel to the longitudinal axis of the handle, so that the unit can be manipulated in a manner similar to a comb or brush. The blade drive includes a transmission comprising a pair of eccentrics which are selectively phaseable to provide full range of stroke by addition and subtraction of their eccentric throws. The eccentrics are retained in their selected phase relationship by spring and frictional means which provide an overload release permitting the eccentrics to rephase to zero stroke when the imposed load overcomes the phase-retaining means. Control of the unit is effected by a rotatable and depressable button which controls the drive motor, adjusts the blade stroke by phasing of the eccentrics, and lowers the cutting blade or blades from a retracted position into a cutting position.

17 Claims, 8 Drawing Figures

CUTTING TOOL

BRIEF DESCRIPTION OF THE PRIOR ART

A variety of shears and clippers have been developed for the purpose of cutting, thinning and trimming hair by the use of reciprocating, toothed blades.

The more common form of trimmer is that of a reciprocating head carrying a blade for reciprocation transversely of the axis of the handle of the unit which not only makes such units clumsy for self-grooming, but also requires a specific articulation of the hand which is completely different from the more natural, flowing hand-motion typical of brushing and combing.

In addition, such barbers' clippers are limited to relatively short cutting heads which must be applied in many individual strokes or sweeps, in trimming or shaping, while skillfully maintaining alignment of adjacent sweeps to avoid gouging or excessively deep cuts. This difficulty is evident from the attempts that have been made to provide uniformly-articulating gauges for assuring a uniform tapering of their cut adjacent the neckline of haircuts.

Also, such barbers' clippers have had a characteristic buzz-and-clatter noise which is unpleasant, at best, and even startling or fearsome in the case of small children or animals.

Accordingly, in spite of their widespread use, transverse-cutting barber shears have not been found to be entirely satisfactory.

Alternate forms of shears or trimmers have been tried, including the use of a comb and reciprocating blade which are aligned substantially longitudinally of the instrument and its handle. These have ranged from finger-actuated units to powered types and are, in fact, more convenient and facile in use because of the orientation of their handles and working elements in a manner similar to the orientation of combs and brushes.

However, these latter clippers or trimmers are still prone to unintentional gouging of the hair or, alternatively, provide excessively light cuts requiring repeated strokes to achieve the desired effect.

If high motor and blade speeds are used in such units, the noise factor is a strong deterrent with regard to self-grooming by untrained individuals. If low motor and blade speeds are used, the motor-noise factor may be reduced, but the sickle-bar or mowing-machine noise of the blade may remain, particularly if the blade is relatively long.

More significant, in regard to the actual capability of such units, is the fact that different cutting rates are needed in the performance of different stages of cutting or shaping the hair. A substantial cutting rate is desirable for tapering. A lesser cutting rate is advantageous in thinning operations, while a minimum cutting rate is most desirable for blending adjacent zones to provide a smooth, finally-shaped cut.

Where transverse reciprocating barber shears are able to accommodate these differing requirements by the use of several interchangeable cutting heads, the cutters of longitudinal clippers are not so readily interchanged as are the smaller, snap-on heads.

This is especially important if it is desired to avoid complexity and to overcome the reluctance of unskilled persons to employ powered clippers in self-grooming. The long blade and guard assemblies inherent in longitudinally-reciprocating clippers would add a distinct inconvenience if it were attempted to provide multiple heads of differing cutting rates.

In order to avoid the need for multiple cutting heads or multiple units, it has been necessary to provide a compromise in cutting rate which is advantageous in only one step of the hair cutting operation and sacrifices efficiency and quality of results in other cutting steps.

Additionally, prior reciprocating clippers or shears have been prone to jamming of the cutting blades when they encounter more than their drive power and blade sharpness can cut through. The manipulation necessary to free the shears from the jamming hair or trapped material can be painful, in the case of hair clippers, or dangerous to the user, in the case of heavier duty shears. Certain prior shear units have included overload protection means to protect the electric motors of the unit. However, means are needed to release the "lock-up" in the drive train to free the driven blade so that it can idle or travel to a non-biting position with regard to the opposing or stationary teeth and thereby facilitate release of the jammed material.

Therefore, prior shears and trimmers have not been found to be entirely satisfactory.

OBJECTS OF THE INVENTION

It is an object of the present invention to provide a cutting unit having a cutting blade reciprocable generally parallel to the longitudinal axis of the unit.

It is another object of the present invention to provide a reciprocating cutting unit having means to vary the length of the cutting stroke.

It is another object of the present invention to provide a reciprocating shear having means to vary the length of the cutting stroke.

It is another object of the present invention to provide a reciprocating cutting unit having plural eccentrics in its drive train and means for phasing the eccentrics to vary the length of the cutting stroke.

It is another object of the present invention to provide a reciprocating cutting unit having a drive including phaseable eccentrics for varying the cutting stroke and phase-retaining means which permit the eccentrics to re-phase to a lesser or zero stroke position under overload or jammed-blade conditions.

It is a further object of the present invention to provide a reciprocating shear having toothed blades in adjacent shearing relationship longitudinally of the unit and variable in the length of the shearing stroke therebetween.

It is a still further object of the present invention to provide a shearing and clipping unit having toothed blades in adjacent shearing relationship longitudinally of the unit and having plural eccentrics which are phaseable with respect to each other to vary the length of stroke of a reciprocating blade.

A further object of the present invention is the provision of a hair clipping and shaping instrument having a shear blade reciprocable generally parallel to the longitudinal axis of the handle and having a means to vary the length of stroke of reciprocation of the blade.

A further object of the present invention is the provision of a hair grooming instrument having curvate shearing blades extending longitudinally of the unit and reciprocable with respect to each other along a guided curvate path parallel to their line of curvature.

A further object of the present invention is the provision of an instrument for tapering, thinning and cutting hair by shearing blades having a curvature of their cutting edges approximating the curvature of the human head and reciprocable with respect to each other along a curvate path generally parallel to the handle of the instrument and defined by a retaining guide including ball bearings engaging curvate grooves in the blades which are parallel to the curvature of the cutting edges.

A further object of the present invention is the provision of a hair cutting and grooming instrument having shearing blades reciprocable adjacent a hair-engaging member and retractable in a housing behind the hair engaging member to permit use of the hair engaging member without engagement of the hair by the shearing blades.

A further object of the present invention is the provision of a hair cutting and grooming instrument having motor-driven shearing blades reciprocable adjacent a hair-engaging member and biased to retract into a housing until the drive motor is energized.

It is a particular object of the present invention to provide a hair cutting and grooming instrument having a housing including a handle, motor driven shear blades reciprocable with respect to each other and generally parallel to the longitudinal axis of the handle, the stroke of reciprocation being adjustable in length and the shear blades being normally retracted within a portion on said housing and the instrument further having a single control member for actuating the drive motor, varying the length of stroke and projecting the shear blades from their retracted position to a cutting position adjacent a hair-engaging member on the housing.

BRIEF DESCRIPTION OF THE DRAWINGS

These and other objects of the present invention, as well as a better understanding thereof, may be derived from the following descriptions and accompanying drawings, in which.

DETAILED DESCRIPTION OF THE PREFERRED EMBODIMENT

Figure 1:
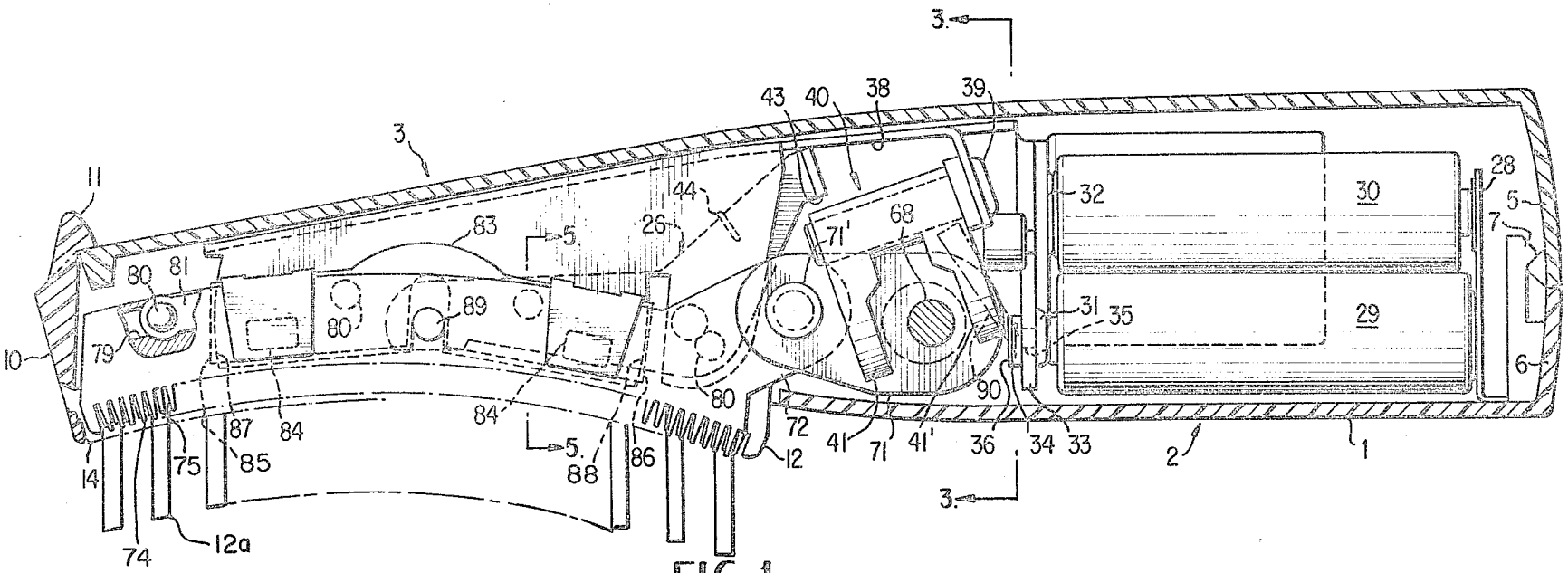
FIG. 1 is a side elevation, partly in section, of the preferred embodiment of the present invention as a hair trimmer.
Figure 2:
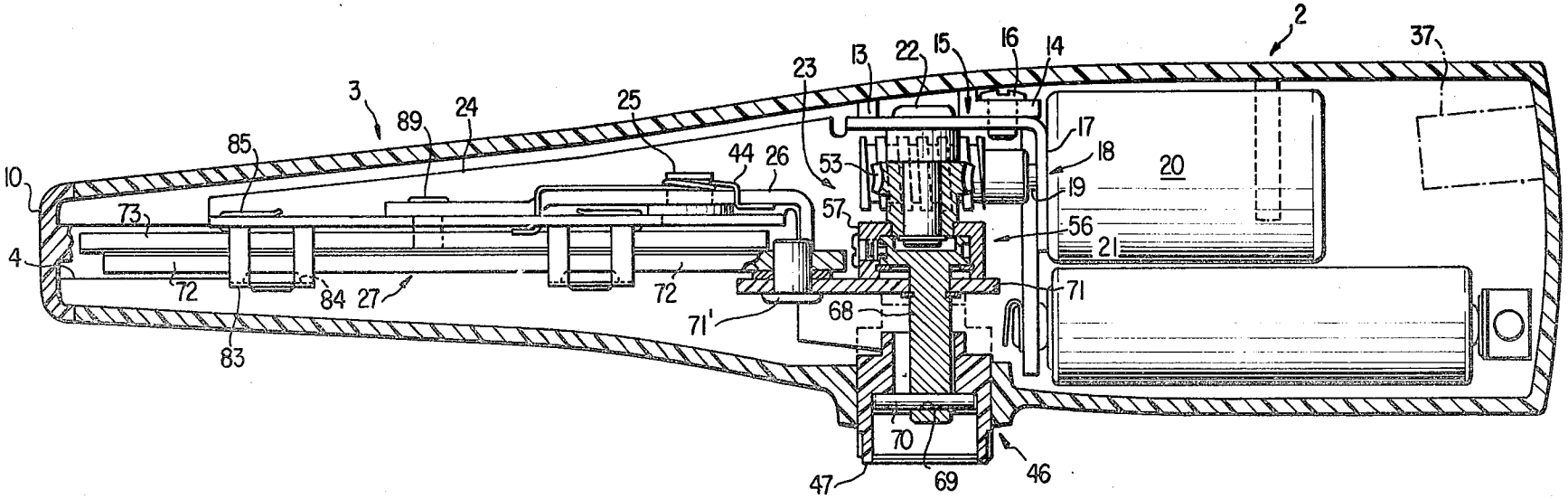
FIG. 2 is a top view, partly in section, of the unit of FIG. 1.

As shown in the drawings, the preferred form of hair trimmer of the present invention includes a casing 1 having a handle 2 and an anterior, narrowed portion 3 having an elongated slot 4 in its lower region. The casing 1 is formed by molded, separable upper and lower halves 5 and 6, respectively, which are secured by integrally-molded, snap catches 7 distributed about the periphery of the joining skirts 8 and 9 of the respective halves. At its forward wall 10, the lower half 6 carries an elongated catch member 11 which engages the upper surface of the upper half 5.

The narrowed portion of the lower half 6 includes a removable portion 12 carrying the slot 4 and further secured by integrally-molded catches 13. Advantageously, a variety of removable portions 12 may be supplied with varying configurations of combs or rakes for engagement with the hair.

Internally, the casing includes an upright boss 14 integral with the lower half and mounting an L-shaped bracket 15 by means of a main screw 16. The bracket 15 includes a rear flange 17 having an aperture 18 therein for receiving the shaft 19 of a motor 20 which is suitably mounted on the rear flange such as by screws 21.

Adjacent the main screw 16, the bracket carries a riveted shaft 22 carrying a drive train 23, described more fully hereinafter. A forward extension 24 of bracket 15 carries a transverse shaft 25 which mounts a lever 26 carrying a blade assembly 27, also discussed more fully hereinafter.

In the portion of the casing surrounding the motor 20, the lower half 6 carries a spring arm 28 for engaging a pair of batteries 29 and 30 which engage contacts 31 and 32 on an insulator wall 33 mounted on the rear flange 17 of the main bracket by the motor-mounting screws 21. The contact 22 includes a leaf portion 34 extended through an aperture 35 in the wall 33 to form a switch contact 36.

If desired, power may be delivered to the motor from an external source via a jack member 37, shown in dot-dash lines, instead of the batteries.

Forward of the motor and the switch contact 36, the main bracket 15 has a top flange 38 which mounts a riveted shaft 39 at a slight angle to the longitudinal axis of the casing. The shaft 39 carries a rocker arm 40 suitably secured thereon for a rocking motion. The rocker arm 40 includes a pair of downwardly extending fork arms 41 and 41' as well as a top arm 42 positioned to rock into lifting engagement with the rearward end 43 of the blade assembly lever 26. A spring 44 mounted on the forward extension 24 of the main bracket 15 engages and exerts a downward force on the rear portion of the blade assembly lever 26 and, consequently, the top arm 42 of the rocker arm 40.

Figure 3:
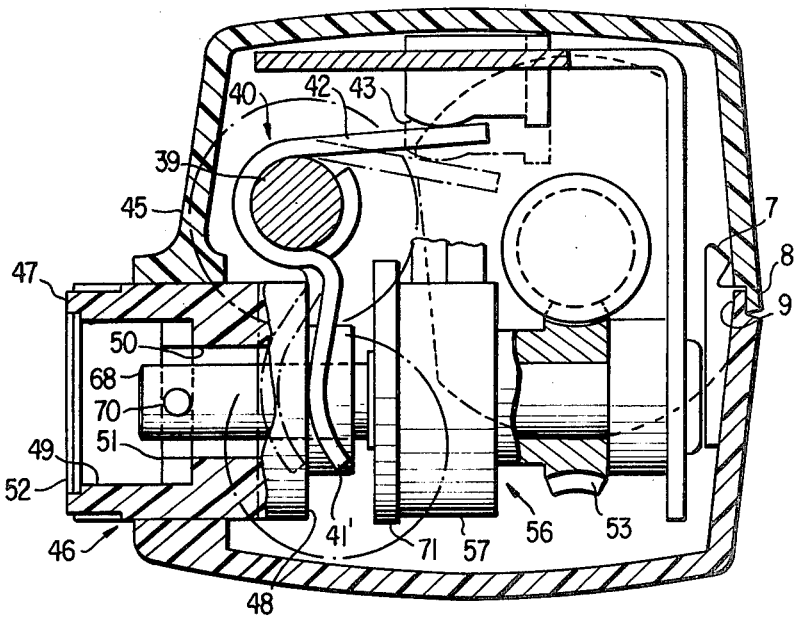
FIG. 3 is a cross-sectional view taken on lines 3—3 of FIG. 1.

The downward force of spring 44 biases the rocker arm so that its fork arms 41 and 41' are rocked outwardly toward the side wall 45 of the casing, as can best be seen in FIG. 3.

Adjacent the fork arms 41 and 41', the side wall 45 includes an aperture 46 mounting a round control button 47, coaxial with the shaft 22 mounting the drive train, for reciprocation toward and away from the fork arms 41, 41' which it engages via a shoulder 48. The control button 47 has a central stepped bore therein including a larger bore 49 and a shaft bore 50. At the junction of the bores 49 and 50, the control button includes a splined section 51 of the large bore, whose purpose will be explained more fully hereinafter. The control button also includes a closing cap 52.

The mounting shaft 22 of the drive train, opposite and coaxial with the control button 47, carries a worm-geared sleeve 53 rotatably secured thereon, such as by a c-clip 54, and which meshes with a worm-drive pinion gear 55 mounted on the motor shaft 19. The worm-geared sleeve carries a first eccentric member 56 fixed thereon which includes a main portion 57 having a cylindrical bore 58 thereon whose axis is offset from the axis of the shaft 22 and sleeve 53 a selected radial distance.

A second eccentric member 59 includes a cylindrical portion closely but loosely fitted within the cylindrical bore 58 of the first eccentric member. The cylindrical portion 60 is axially pressed against a shoulder 61 of the first member by a dished spring 62 seated in a groove 63 in the bore 58 of the first eccentric. The cylindrical portion 60 of the second eccentric includes a peripheral channel 64 which extends over 180° of its circumference and which is engaged by a spring-loaded pin 65 mounted in the wall of the main portion of the first eccentric. The pressure with which the pin 65 bears against the cylindrical portion 60 may be adjusted by a set screw 67 bearing against the coil spring 66. The combined frictional loading imposed by the dished spring 62 and the pin spring 66 resist relative rotation of the cylindrical portion 60 in the eccentric bore 58, while the pin 65 limits the extremes of such relative rotation when the frictional loading is overcome, as will be discussed more fully hereinafter with regard to operation of the unit.

The second eccentric member 59 also includes a shaft portion 68 which extends transversely of the casing toward the control button 47 and extends through the shaft bore 50 to terminate well within the large bore 49. In the region of the splined section 52, when the button is fully outwardly extended by the fork arms 41, 41', the shaft portion has a transverse bore 69 loosely carrying a clutch pin 70 in full engagement with opposite spline grooves of the button.

The shaft portion 68 is radially offset or eccentric with respect to its cylindrical portion 60, an amount equal to that of the eccentricity of the main portion and bore of the first eccentric 56. The peripheral channel 64 is to be located on the peripheral surface of the cylindrical portion 60 of the second eccentric so that it will permit phasing of the two eccentric throws from maximum, as in FIG. 4*a*, to zero as in FIG. 4*b*. The maximum eccentric path of the shaft portion 68 is to be accommodated by sufficient diameter in the shaft bore 50 to prevent interference of the two.

Intermediate the cylindrical portion and the button, the shaft 68 engages a crank arm 71 positioned by a C-clip and having a pin 71' which engages a movable toothed blade 72 of the blade assembly 27.

The blade assembly includes a stationary toothed blade 73 fixed on the lever 26. The blades 72 and 73 have closely-associated, curvate toothed cutting edges 74 and 75, respectively, and curved spines 76 and 77. The spines 76 and 77 have curved grooves 78 and 79, on their adjacent faces, with a plurality of ball bearings 80 longitudinally spaced in the channel formed by the grooves. The longitudinal spacing of the balls 80 is fixed by a thin retainer 81 having individual apertures 82 for loosely receiving the balls without interference therewith or with the surfaces of the blades.

The blades are retained against separation by an elongated assembly yoke 83 of spring material which spans the spines of the blades and includes longitudinally spaced, opposed sets of bearing pads 84. The spring yokes included U-shaped, spring-clip guides 85 and 86 which engage both sides of the forward extension 24 of the main bracket 15 along forward and rearward guide edges 87 and 88, respectively, on the extension 24. The guide edges 87 and 88 are preferably equidistant with regard to the pin 89 fixing the stationary blade on the lever 26 and are slightly curved to prevent binding.

The electrical connections between the batteries and the motor 20 are conventional and have not been detailed in order to avoid complication of the drawings. However, a leaf contact 90 is included and is mounted on the fork arm 41' of the rocker arm 40 to form a switch with the adjacent switch contact 36. The leaf contact is positioned to engage the contact 36 and close the motor circuit after the button has been depressed sufficiently to disengage the spline section 51 from the clutch pin 70 in the large bore 49 of the botton.

OPERATION OF THE PREFERRED EMBODIMENT

Figure 4A:
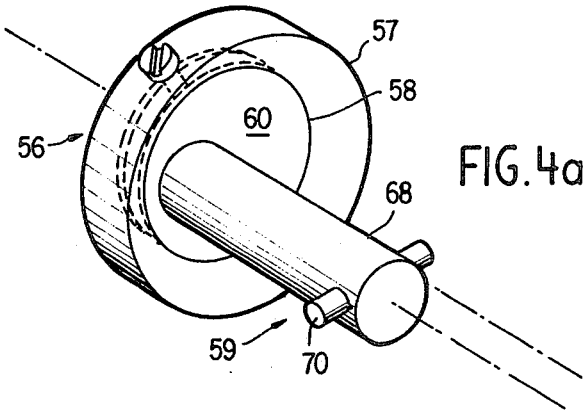
FIG. 4*a* is a perspective view, partly cut away, of a portion of the phaseable eccentric drive phased to maximum eccentricity.
Figure 4B:
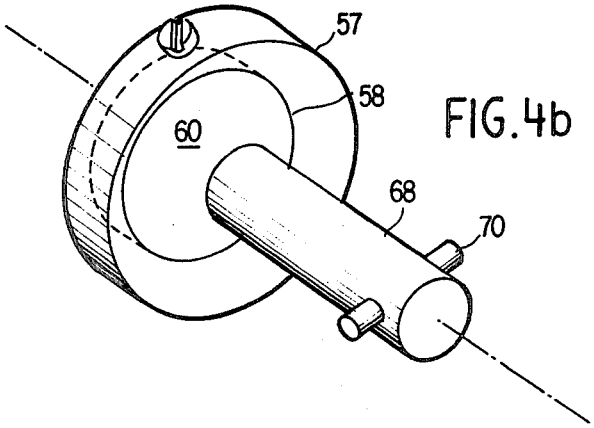
FIG. 4*b* is a view similar to FIG. 4*a* and showing the drive phased to zero eccentricity.
Figure 5:
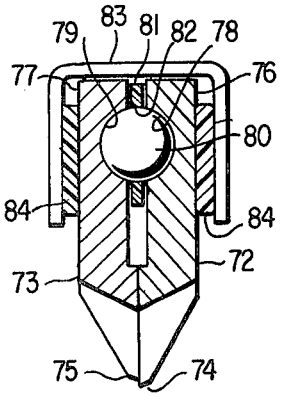
FIG. 5 is a cross-sectional view, on an enlarged scale, of a portion of FIG. 1 and taken on lines 5—5 thereof.
Figure 6:
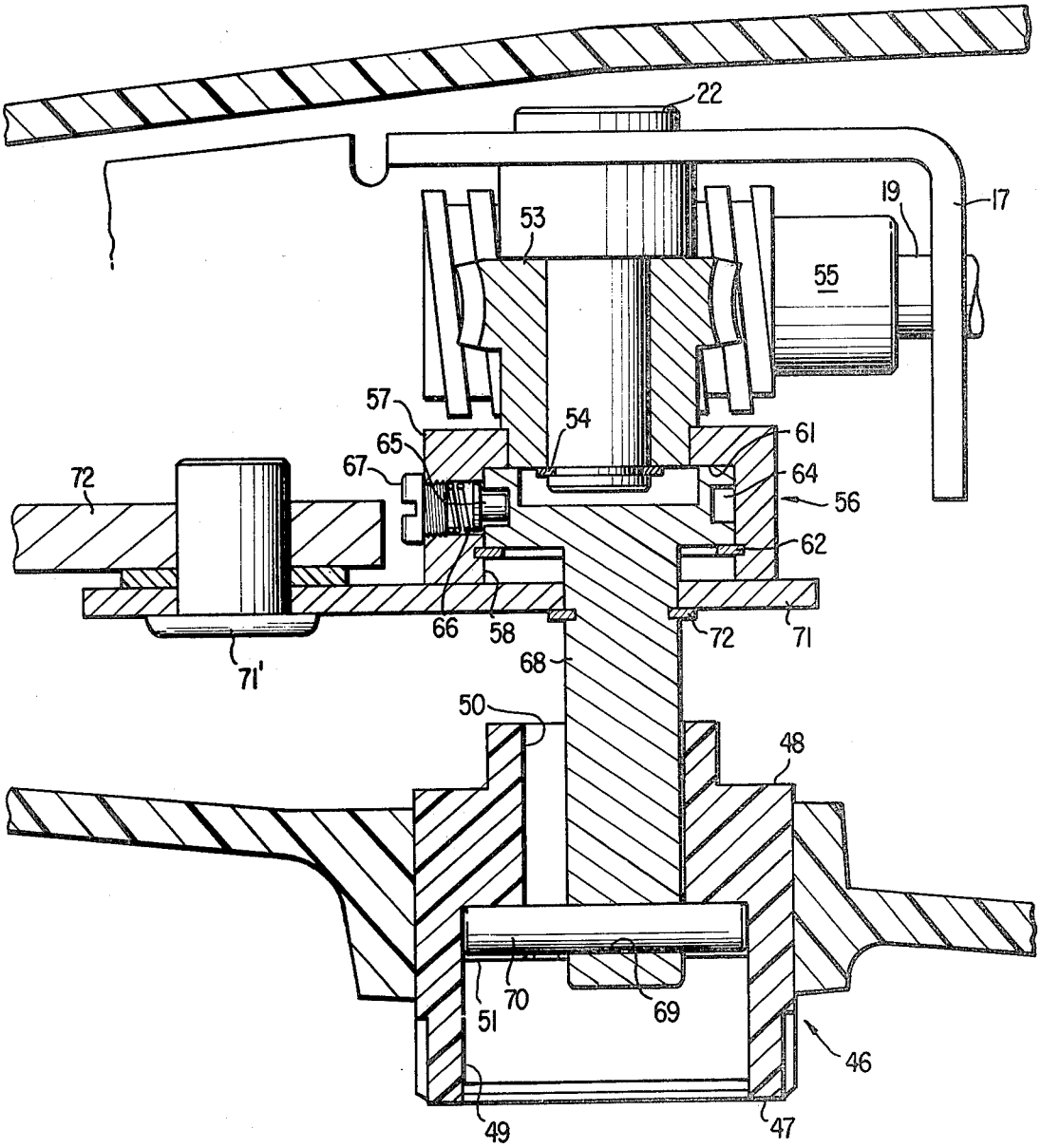
FIG. 6 is an enlarged view of a portion of FIG. 2.
Figure 7:
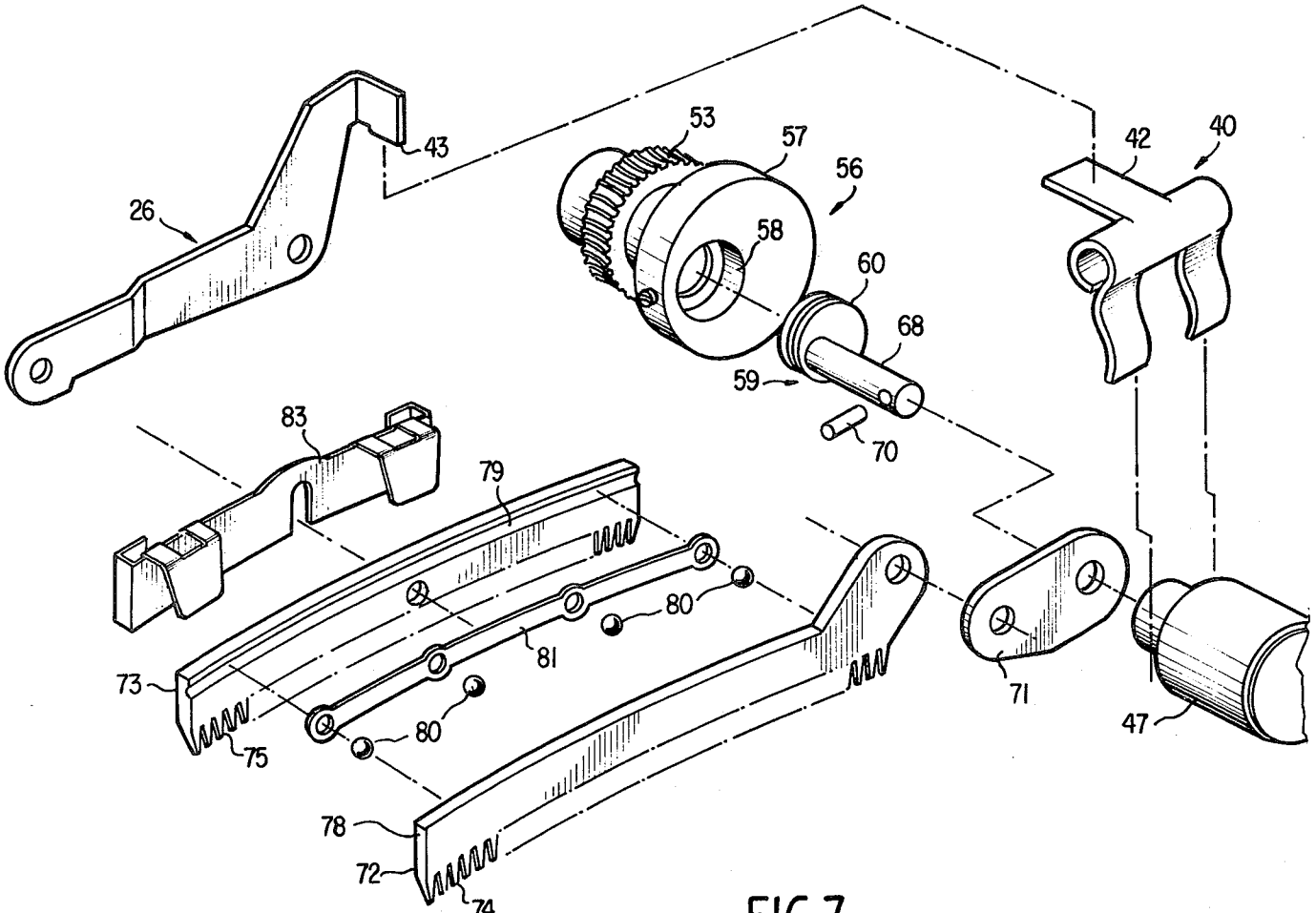
FIG. 7 is an exploded view showing the relationship of the drive, control and blade assemblies of the preferred shear.

In operation of the preferred form of hair clipper of the present invention, with the batteries or power source installed, depression of the control button 47 closes the switch contact 90 and 36 to energize the motor 20. The pinion 55 drives the geared sleeve 53, the first eccentric member 56 and the second eccentric member 59. If the first and second eccentric members are phased as shown in FIG. 4*a* to a maximum throw, the shaft 68 delivers a maximum reciprocation to the crank arm 71 and a maximum length of stroke to the movable blade 72.

Simultaneously with the actuation of the switch, rocking of the rocker arm 40 by abutment of the fork arms 41, 41' with the shoulder 48 of the button exerts a lifting pressure via the top arm against the rear end 43 of the lever 26, thereby overcoming the bias of the spring 44 and causing the blade assembly to be extended through the slot 4 into cutting position adjacent the hair engaging portion of the removable member 12. The hair clipper may then be used in much the same manner as a conventional comb, with the curvate cutting edges of the blades generally conforming to the contour of the head and preventing tangential or chordal cutting as might occur with straight cutting edges.

When it is desired to change the stroke of the cutting blade assembly, the control button is released to break the circuit to the motor and, simultaneously, to retract the blade assembly under the bias of the spring 44. With the button thus extended fully outwardly of the casing, the clutch pin 70 is thus returned to its clutching engagement with the splined section 51 so that the control button is in positive, rotational engagement with the shaft portion 68 of the second eccentric 59. Rotation of the button, within the limits imposed by the peripheral channel 64 and spring loaded pin 65, rephase the eccentricity of the first and second eccentric members to a desired location between the maximum shown in FIG. 4*a* and a lesser eccentricity approaching the zero-phase shown in FIG. 4*b*. Since the motor is not energized, it acts as a brake on the first eccentric, via the engagement of its pinion gear with the geared sleeve, so that the rotation of the button may be effective in overcoming the friction of the dished spring 62 and the spring loaded pin 65 to rephase the eccentrics. Thereafter, when the button is again depressed, the clutch formed by the splined section 51 and clutch pin 70 is disengaged prior to closing of the switch contacts 36 and 90 and the eccentrics are held in a selected phase under the frictional load imposed by the dished spring 62 and spring loaded pin 65. With the button thus depressed, there is no interference between the clutch pin 70 and the large bore 49 of the button, since the clutch pin is freely slidable in the transverse bore 69 of the shaft portion and simply reciprocates within that bore to accommodate the eccentric motion between the shaft portion 68 and the large bore 49 of the button.

If a jam occurs at the shearing blades, the present invention provides a peculiarly advantageous and safe overload release. First, the jammed blade resists further travel, while the motor continues to supply power to the drive. The dished spring 62 and the spring loaded pin 65, under these circumstances, are unable to maintain the selected phase relationship between the two eccentric members and thus permit them to rotate with respect to each other until their eccentrics cancel each other, or rephase sufficiently to relieve the reciprocating pressure, if the motor power is cut-off sufficiently quickly. Release of the jam is easily accomplished by means of rotation of the phasing clutch until the biting or shearing pressure between the shearing teeth is released, whereupon the jamming material is readily freed without pulling or tearing and without dangerous manipulation by unprotected fingers. The retractable blade of the preferred hair clipper supplements this jam-release ability of the present invention by providing a retracting force tending to separate the blade and the jamming material transversely with regard to the line of reciprocation of the blade and, therefore, out from between the teeth as soon as the shearing pressure is relieved.

In the preferred embodiment of the present invention as a hair clipper, the relatively long, arcuate cutting assembly and its longitudinal alignment with the handle portion of the casing not only provides for an extremely convenient natural hand motion quite similar to the normal combing motion, but also permits the unit to be used as a comb intermediate actual cutting strokes, particularly since the cutting assembly is retracted within the housing when the control button is released. In this configuration, the comb element 12*a* mounted on the removable portion of the lower housing may be used to smooth and realign a fresh cut, without the necessity of using a separate comb for that purpose. As soon as the smoothing has been effected, it is simply a matter of again pressing the control button to resume the cutting operation. This capability can be of particular advantage where the comb element 12*a* of the removable portion 12 of the housing is to be used as a depth gauge for a trimming operation such as that which is necessary with beards.

Therefore, it is apparent that the present invention has achieved its objectives and provides a particularly advantageous shear for trimming and grooming hair. Furthermore, it is apparent that the present invention provides distinctly advantageous advances in safety and ease of operation which may be employed with reciprocating cutting units other than hair clippers alone.

Therefore, various changes may be made in the details of the invention as it has been disclosed without sacrificing the advantages thereof or departing from the scope of the appended claims.

What is claimed is:

1. A hair cutting instrument comprising a housing having an elongated handle portion, first and second blades mounted in shearing relationship and extending generally longitudinally with respect to said elongate handle, reciprocation means for reciprocating at least one of said blades substantially parallel with the long axis of said handle, stroke means for varying the length of stroke of reciprocation, a hair-grooming member on said housing adjacent said blades, and an extension of said housing adjacent said blades, means for normally retracting said blades into said housing extension, and lever means for selectively projecting said blades from said housing extension to adjacent said hair grooming member.

2. The hair cutting instrument of claim 1 including a depressable control button in said housing, said lever means including a lever positioned to be displaced by depression of the control button, and said reciprocation means including a switch, said switch being positioned to be activated by depression of said control button.

3. The hair cutting instrument of claim 2 in which said stroke means includes a rotary clutch member for adjusting the stroke of reciprocation, said control button includes a rotatable clutch portion, and bias means biasing said clutch portion of said control button into engagement with said clutch member.

4. The hair cutting instrument of claim 3 in which said bias means includes means to bias said control button away from its depressed position.

5. A hair cutter including a housing having an elongated handle portion and an extended portion extended generally longitudinally from said handle portion, a longitudinal aperture in a side of said extended portion, a blade assembly including first and second blades mounted in shearing relationship in said extended portion and extending generally longitudinally with respect to said elongate handle, said cutting blades forming a cutting edge adjacent said longitudinal aperture, reciprocation means for reciprocating at least one of said blades substantially parallel with the long axis of said handle, mounting means for mounting said blade assembly for motion toward and away from said longitudinal aperture, biasing means for biasing said blade assembly to a normal position within said extended portion so that said cutting edge does not protrude through said aperture, and control means for selectively opposing said biasing means so that said cutting edge protrudes through said aperture.

6. The hair cutter of claim 5 including a motor drive for reciprocating said cutting edge longitudinally of said longitudinal aperture, a control member connected to control said motor drive, and said control means including lever means engageable by said control member for simultaneously overcoming said biasing means when said motor drive is energized.

7. The hair cutter of claim 6 in which said mounting means includes a hinge having an axis substantially transverse to the length of said longitudinal aperture, and said control member is mounted for manual depression on a line substantially parallel to the axis of said hinge.

8. A reciprocating cutting tool including, a concave blade having a cutting edge, a housing, means for mounting said blade on said housing for arcuate reciprocation, drive means for arcuately reciprocating said blade, said drive means including stroke varying means, said stroke varying means including an eccentric group comprising at least two rotary eccentric members mounted for rotation on a primary rotational axis, said eccentric members each having an eccentric engagement member, coupling means for coupling said eccentric members in driving engagement to transmit power from a first of said eccentric members through a second of said eccentric members, means for supplying rotational power to said first eccentric member and phasing means for varying the net throw of said eccentric group by phasing the relative rotational positions of said first and second engagement members.

9. The cutting tool of claim 8 in which the first and second eccentric members are substantially equal in the eccentric amplitude of their engagement members.

10. The cutting tool of claim 8 in which the engagement member of said first eccentric member comprises a bore which is eccentric with respect to the primary axis of rotation of the eccentric group, the second eccentric member includes a base member engaged in said eccentric bore, and the engagement member of said second eccentric member is a shaft eccentric in relation to said base member.

11. The cutting tool of claim 10 including retainer means for retaining said base member against free motion with regard to the bore of the first eccentric.

12. The cutting tool of claim 10 in which said phasing means includes a control member having a cylindrical bore positioned to receive a portion of said eccentric shaft, an axial shoulder in said cylindrical bore, said axial shoulder having a plurality of diametrically-opposed, axially-extended clutch teeth, a transverse bore in said eccentric shaft adjacent said clutch teeth, a transverse pin slideably received in said transverse bore, and means mounting said control member for rotary and axial movement to selectively engage and disengage said pin and said clutch teeth to phase said eccentrics.

13. The cutting tool of claim 9 in which said cutting edge has curvate cutting teeth thereon.

14. The cutting tool of claim 13 and including a second blade member adjacent said first-mentioned cutting blade and having curvate teeth positioned to cooperate with the curvate teeth of said first cutting blade.

15. A reciprocating cutting tool including a blade having a cutting edge, a housing, means for mounting said blade on said housing for reciprocation, drive means for reciprocating said blade, said drive means including stroke varying means, said stroke varying means including an eccentric group comprising at least two rotary eccentric members mounted for rotation on a primary rotational axis, said eccentric members having an eccentric engagement member, coupling means for coupling said eccentric members in driving engagement to transmit power from a first of said eccentric members through a second of said eccentric members, means for supplying rotational power to said first eccentric member, phasing means for varying the net throw of said eccentric group by phasing the relative rotational members of said first and second engagement members, the engagement member of said first eccentric member comprising a bore which is eccentric with respect to the primary axis of rotation of the eccentric group, the second eccentric member including a base member engaged in said eccentric bore, the engagement member of said second eccentric member being a shaft concentric in relation to said base member, said phasing means including a control member having a cylindrical bore position to receive a portion of said eccentric shaft, an axial shoulder in said cylindrical bore, said axial shoulder having a plurality of diametrically opposed, axially-extended clutch teeth, a transverse bore in said eccentric shaft adjacent said clutch teeth, a transverse pin slidably received in said transverse bore, and means mounting said control member for rotary and axial movement to selectively engage and disengage said pin and said clutch teeth to phase said eccentrics.

16. The cutting tool of claim 15 in which said control member is normally biased toward engagement of said clutch teeth and said pin, and switch means positioned to be engaged by said control member to operate said drive means when said control member is axially displaced to disengage said pin and said clutch teeth.

17. The cutting tool of claim 15 including abutment means for limiting phasing rotation of said first and second eccentrics to not more than 180° with respect to each other.

* * * * *